United States Patent [19]

Schmidt

[11] Patent Number: 4,925,487

[45] Date of Patent: May 15, 1990

[54] DUST COLLECTION IN SINTERING OF METALLURGICAL PRODUCTS

[75] Inventor: Hermann Schmidt, Bad Vilbel, Fed. Rep. of Germany

[73] Assignee: Metallgesellschaft Aktiengesellschaft, Frankfurt am Main, Fed. Rep. of Germany

[21] Appl. No.: 312,672

[22] Filed: Feb. 17, 1989

[30] Foreign Application Priority Data

Mar. 2, 1988 [DE] Fed. Rep. of Germany ..... 3806591

[51] Int. Cl.[5] ..... C22B 1/20

[52] U.S. Cl. ..... 75/749; 75/758; 266/157

[58] Field of Search ..... 75/5, 25; 266/157

[56] References Cited

U.S. PATENT DOCUMENTS

| | | | |
|---|---|---|---|
| 3,909,189 | 9/1975 | Ban | 75/5 |
| 4,050,924 | 9/1977 | Cappel et al. | 75/5 |
| 4,536,211 | 8/1985 | Futakuchi et al. | 75/5 |

*Primary Examiner*—Melvyn J. Andrews
*Attorney, Agent, or Firm*—Herbert Dubno

[57] ABSTRACT

The separation rate of electrostatic precipitators associated with sintering plants is improved in that the exhaust gas is conditioned by means of solid particles. For that purpose, part of the coke breeze as a fuel for the sintering process is branched off, separately ground, supplied to the exhaust gases to be dedusted, collected together with the dust in the electrostatic precipitators and returned to the sintering process.

4 Claims, 1 Drawing Sheet

DUST COLLECTION IN SINTERING OF METALLURGICAL PRODUCTS

FIELD OF THE INVENTION

My present invention relates to improvement of electrostatic precipitator dust collection in sintering processes, especially sintered-iron production.

BACKGROUND OF THE INVENTION

Electrostatic precipitators can be used for dust collection in sintering plants which can have supply bins and handling means for iron ore, lime, coke breeze and returns, a driven revolving sintering belt provided with a plurality of suction boxes disposed under the belt, an exhaust fan for withdrawing exhaust gases from the sintering belt, an electrostatic precipitator preceding the exhaust fan, sieving means and an exhaust fan that is preceded by an electrostatic precipitator for dedusting the room. A fine-grained solid conditioning agent can be supplied to the exhaust gas stream to improve the separating rate of the electrostatic precipitator or precipitators.

It has long been known that exhaust gases may be conditioned to improve the separation rate of electrostatic precipitators.

Fine-grained solids as conditioning agents have, however, been given different evaluations aand have not played a significant role in practice thus far.

In accordance with British Patent Specification 559,532 of 1942, non-conductive dusts can be removed from gases or air by electrostatic separation if so-called powdered fuel grits are admixed with the gases or the air.

Such powdered fuel grits consist of the solid particles which are entrained by the exhaust gas from pulverized coal-fired boiler furnaces and are separated in electrostatic precipitators. They constitute a flue ash, which may contain 3 to 70% unburned coal (lines 68 to 82 on page 3 and claim 1).

"Journal of the Institute of Fuel" (May 1963) contains on pages 184 to 197 a report on the influence which is exerted by the properties of coal and of the combustion of the efficiency of electrostatic dust collectors. It has been stated there that the carbon content does not have a strong influence on the separation rate, but the influence of the particle size may be significant. If coal and oil are burned at the same time, an incomplete combustion of the oil may result in a formation of fine soot particles, which will deposit as a layer on the dust particles so that their electrical resistance is strongly reduced and their separation in the electrostatic precipitator is strongly promoted.

On the other hand, unburned matter from the coal will be relatively coarse-grained and will not have a measurable influence on the separation rate (penultimate and last paragraph on page 195, first paragraph on page 196).

"Staub", 25 (1965) contains on pages 402 to 409 a report on the problems arising in connection with electric dedusting. It is stated there that particles having a high electrical conductivity (coke, metal) will adversely affect the separation of dust in an electrostatic precipitator and that a higher degree of separation can be achieved in much smaller electrostatic precipitators if the coal is completely burned and care is taken that coke particles will not enter the electrostatic precipitator (last paragraph on page 408, first paragraph on page 409, Abstract).

In his book "Entstaubung industrieller Gase mit Elektrofilter" (VEB Verlag Leipzig 1969), H. J. WHITE states on page 275: "Very fine particles, such as soot, tend to deposit on insulating particles and to surround the same with a conductive layer. For this reason, they will become effective even in small amounts of only a few percent of the total mass of the dust. On the other hand, coke particles are relatively coarse when compared with the soot and are required in a content of 10 to 20% by mass."

Similar remarks have been made by the author of that book in "Journal of the Air Pollution Control Association", Vol. 34, No. 4 (April 1974) on pages 314 to 338, particularly in the last paragraph of the left-hand column and the first paragraph of the right-hand column on page 330.

The book "Elektrostatic Precipitators" (1982) by Jaraslav Böhm contains the summary statement that conductive coarser particles, such as unburned coke, in flue ash cannot effect an improvement of the separation rate but by a disturbance of the electric field may even result in a deterioration.

It has been stated there that they may improve the separation rate only when present in relatively large proportions (10 to 20%). On the other hand, it has been states there that soot in a content of even less than 10% may strongly decrease the resistance of the dust. It is apparent that the publications mentioned above do not furnish a clear teaching for technical action to a person who desires to improve by a conditioning action, the separation rate of an electrostatic precipitator which is unsatisfactory in operation due to an excessively high dust resistance in cases in which the dust contains potassium chloride so that $SO_3$, which is known per se and probably is the most effective conditioning agent, cannot be used for the reason.

It will be understood that as in all conditioning processes, the expenditure must not exceed the advantages which are afforded. Coke and soot are combustible substances, which will not carelessly be discharged in appreciable quantities together with the dust if the improvement of the separation rate can be effected more economically by different methods.

In sintering plants, it is necessary to collect dust from the exhaust gases from the sintering belt and from the room air. The gases to be dedusted become available at high rates and have high contents of dust having a low electrical conductivity so that conditioning agents are required at a correspondingly high rate.

It is an object of the invention to provide an economically acceptable conditioning without the use of $SO_3$ for this purpose, especially in an iron sintering process.

SUMMARY OF THE INVENTION

That object has been accomplished in accordance with the invention in that the coke breeze which is provided as a fuel for the sintering process is used as a conditioning agent. From 0.5 to 15% of the total amount of fuel is branched off and separately supplied to the exhaust gases from the sintering belt through one of the suction boxes. That amount of coke is subsequently collected in the electrostatic precipitator together with the dust and is subsequently returned to the sintering process.

If the air which has been drawn off for the dedusting of the room is to be conditioned too, 2 to 10% of the coke breeze required as a fuel may be branched off and separately milled. One part of that amount of coke is supplied to one of the suction boxes associated with the sintering belt and the other part is supplied to the suction line for dedusting the room. In that case, about 20% of the branched off amount of coke will be supplied to one of the suction boxes associated with the sintering belt. Finally, it is contemplated that the amount of coke breeze which has been branched off is ground to a median particle size $d_{50}$ between 2 and 20 μm.

The method of the invention for producing an iron-containing product thus comprises the steps of:

(a) feeding a mixture of iron ore, lime, coke breeze and recycled dust to a rotating sintering belt at an upstream end thereof;

(b) driving the sintering belt to advance the mixture toward a downstream end of the belt while effecting reaction of the mixture on the belt with the coke serving as a fuel for sintering to form the sintering iron-containing product and an exhaust gas, and discharging the sintering iron-containing product from the belt at the downstream end thereof;

(c) drawing the exhaust gas from the belt through a plurality of suction boxes disposed below the belt and arrayed between the ends;

(d) branching a quantity of 0.5 to 15% of the amount of the coke breeze required as the fuel from a coke breeze stream supplied to the mixture;

(e) grinding the quantity of coke breeze branched in step (d);

(f) withdrawing the exhaust gas in an exhaust-gas stream from the suction boxes and supplying the exhaust-gas stream to an electrostatic precipitator for dedusting the exhaust-gas stream;

(g) collecting room gas from locations at which dust is generated and supplying the room gas in a room-gas stream to an electrostatic precipitator for dedusting thereof;

(h) feeding one portion of the quantity of coal breeze ground in step (e) and branched in step (d) to one of the suction boxes to condition the exhaust-gas stream prior to dedusting thereof;

(i) feeding another portion of the quantity of coal breeze ground in step (e) and branched in step (d) to the room-gas stream to condition the room-gas stream prior to dedusting thereof;

(j) recovering coke with precipitated dust at the electrostatic precipitators in an amount substantially equal to the mount of coke breeze ground in step (e) and branched in step (d); and (k) supplying the coke recovered in step (j) to the mixture fed in step (a) to the belt.

The invention is based on various considerations which, in combination, permit the object set forth to be accomplished in a desirable manner.

Due to the use of the coke breeze which is available anyway, there is no need for the provision of a separate conditioning agent so that a first economical advantage is afforded.

The separate grinding of the coke breeze will result in a particle size which is favorable for the conditioning so that the rate at which coke breeze is branched off may be relatively low and the expenditure involved in the additional treatment of such amount will hardly be significant in comparison with the normal use of that amount as a fuel.

It is particularly important that the conditioning agent which has been separated with the dust can virtually completely be returned to the sintering process and used as fuel therein. This means that the improvement of the separation rate of electrostatic precipitators in sintering plants in the manner that is taught by the invention will not involve additional costs for the conditioning agent. It has thus been shown that a distinct improvement of the separation rate can be achieved with a very low additional expenditure (piping, coke mill, grinding work).

This can be demonstrated by the following data, which have been obtained in a pilot operation.

In a sintering machine having a suction area of 150 $m^2$ and operating at a sintering rate of 5,250,000 kg per day, coke is consumed at a rate of 263,000 kg per day. Exhaust gas is produced on the sintering belt at a rate of 550,000 $sm^3/h$ ($sm^3$=standard cubic meter) and contains 2 g dust per $sm^3$. As a result, dust becomes available at a rate of 26,400 kg/day. If conditioning agent is used at a rate of 10% of that dust rate, coke breeze at a rate of 2,600 kg/day must be branched off, separately ground and supplied to one of the suction boxes associated with the sintering belt. This is not more than 1% of the quantity of coke consumed per day.

The electrostatic precipitator for dedusting the room is required to purify exhaust air at a rate of 300,000 $sm^3/h$. As that air contains 15 g dust per $sm^3$, dust is collected at a rate of 108,000 kg per day.

If 10% conditioning agent is used for that purpose too, coke breeze at a rate of 10,800 kg per day will have to be branched off, separately ground and supplied to the exhaust air line. This is about 4% of the coke that is required as a fuel.

If coke breeze for the two electrostatic precipitators is branched off in a total amount of about 5% and is separately ground to have a median particle size $d_{50}$ of 5 μm and is supplied at a ratio of 1:4 to one of the suction boxes associated with the sintering belt and to the exhaust air line, respectively, the dust content of the pure gas may be decreased from 420 to 173 $mg/sm^3$, i.e., the residual dust content will be decreased by almost 60%.

In dependence on the residual dust content which is permissible in the pure gas, coke at a higher or lower rate will have to be branched off for use as a conditioning agent. The separation rate may also be influenced by the grinding fineness. Only the grinding work is significant as regards the costs, because all of the coke breeze which has been finely ground for use as a conditioning agent can be utilized as a fuel for the sintering process.

BRIEF DESCRIPTION OF THE DRAWING

The above objects, features and advantages of our/my invention will become more readily apparent from the following description, reference being made to the accompanying drawing, the sole FIGURE of which is highly simplified and diagrammatic flow scheme showing a sintering plant.

SPECIFIC DESCRIPTION

Figure 1:
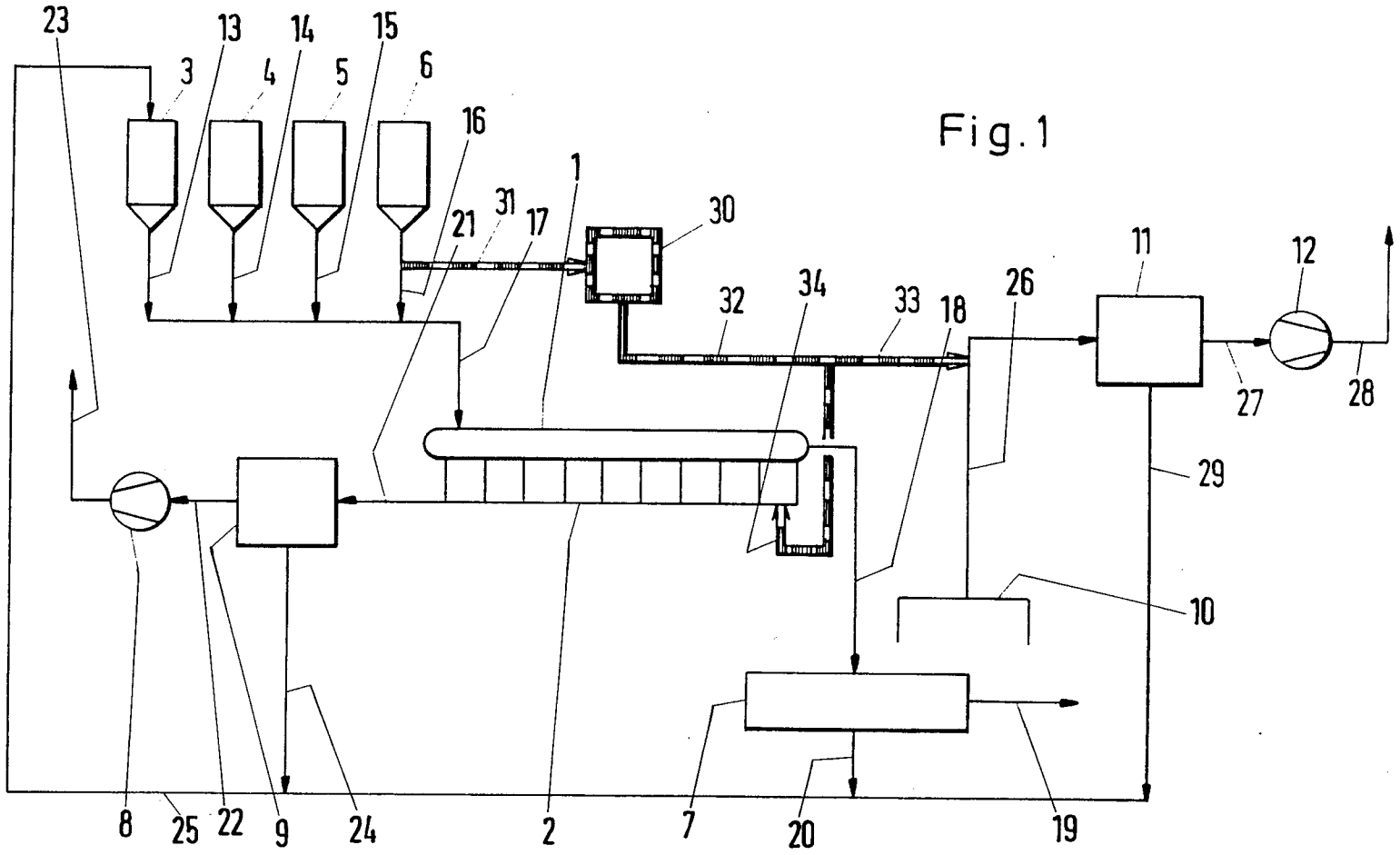

Those parts of the plane, referring to the drawing, which are required to carry out the process in accordance with the invention have been emphasized.

The sintering plant shown in a simplified representation essentially consists of supply bins 3 to 6 and handling means 13 to 16 for iron ore 4, 14, lime 5, 15, coke breeze 6, 16 and returns 3, 13, also of a driven revolving sintering belt 1, which is charged from line 17 with the mixture to be sintered.

A plurality of suction boxes 2 are provided below the sintering belt 1.

By fans 8, the exhaust gases from the sintering process are exhausted from said suction boxes via line 21, the electrostatic precipitator 9 and the line 22 and are delivered via line 23 to the chimney, not shown.

The sintered material is conveyed in line 18 to the sieving means 7, from which the final sintered product is withdrawn via line 19.

An exhaust fan 12 that is preceded by an electrostatic precipitator 11 is also provided for dedusting the room. For this purpose, hoods 10, only one of which is shown, are provided at all locations where dust is raised. The exhaust air is sucked from said hoods via line 26, 27 and is delivered via line 28 to the exhaust air chimney, not shown.

The dust that is collected in the electrostatic precipitators 9, 11 and the undersize that has passed through the sieving means 7 are conveyed via lines 24, 29 and 20 and finally via the return line 25 to the supply bin 3 for returns.

In accordance with the invention, finely ground coke breeze is supplied for conditioning the exhaust gases and the exhaust air from which dust is to be collected in the electrostatic precipitators 9, 11. Coke breezes at the required rate is withdrawn from line 16 via line 31 and is separately ground in the coke mill and via lines 32, 33, 34 is supplied to one of the suction boxes 2 and the exhaust air line 26.

Because the amount of coke that has been branched off for conditioning is separated in the electrostatic precipitators 9, 11 from the exhaust gas from the sintering process and from the exhaust air, respectively, except for very small residual amounts, and is fed via lines 24, 29 to the return line 25 and finally to the supply bin 3 for the returns, the conditioning performed in accordance with the invention with finely ground coke breeze will not involve an additional consumption of material.

The process is highly advantageous economically, because the fuel which is first used for conditioning is almost entirely preserved in the system.

Besides, the rate at which coke is branched off via line 31 can be controlled in view of the requirements of any given case and the quality of such coke may be controlled in dependence on such requirements because the coke mill 30 can be adjusted to a desired grinding fineness. This will ensure that the intended improvement of the separation rate will involve only a minimum of additional cost in each case.

I claim:

1. A method of producing a sintered iron-containing product, comprising the steps of:

(a) feeding a mixture of iron ore, lime, coke breeze and recycled dust to a rotating sintering belt at an upstream end thereof;

(b) driving said sintering belt to advance said mixture toward a downstream end of said belt while effecting reaction of said mixture on said belt with said coke serving as a fuel for sintering to form said sintered iron-containing product and an exhaust gas, and discharging said sintered iron-containing product from said belt at said downstream end thereof;

(c) drawing said exhaust gas from said belt through a plurality of suction boxes disposed below said belt and arrayed between said ends;

(d) separating a quantity of 0.5 to 15% of the amount of the coke breeze required as said fuel from a coke breeze stream supplied to said mixture;

(e) grinding the quantity of coke breeze separated in step (d);

(f) withdrawing said exhaust gas in an exhaust-gas stream from said suction boxes and supplying said exhaust-gas stream to an electrostatic precipitator for dedusting said exhaust-gas stream;

(g) collecting room gas from locations at which dust is generated and supplying said room gas in a room-gas stream to an electrostatic precipitator for dedusting thereof;

(h) feeding one portion of the quantity of coal breeze ground in step (e) and separated in step (d) to one of said suction boxes to condition said exhaust-gas stream prior to dedusting thereof;

(i) feeding another portion of the quantity of coal breeze ground in step (e) and separated in step (d) to said room-gas stream to condition said room-gas stream prior to de-dusting thereof;

(j) recovering coke with precipitated dust at said electrostatic precipitators in an amount substantially equal to the mount of coke breeze ground in step (e) and separated in step (d); and (k) supplying the coke recovered in step (j) to the mixture fed in step (a) to said belt.

2. The method defined in claim 1 wherein said one portion comprises about 20% of the quantity of coal breeze ground in step (e) and separated in step (d).

3. The method defined in claim 1 wherein said quantity of coal breeze ground in step (e) and separated in step (d) is substantially 2 to 10% of the amount of the coke breeze required as said fuel from said coke breeze stream supplied to said mixture.

4. The method defined in claim 1 wherein said separated amount of coke breeze ground in step (e) has a median particle size $d_{50}$ between 2 and 20 $\mu$m.

* * * * *